United States Patent [19]

Oohinata et al.

[11] Patent Number: 5,003,660

[45] Date of Patent: Apr. 2, 1991

[54] COSMETIC APPLICATOR AND METHOD OF PRODUCING THE SAME

[76] Inventors: Osamu Oohinata, 40-13, Kameido 4-Cyome, Koutou-Ku, Tokyo-To; Jun Yanagida, 38-16, Sugamo 5-cyome, Toshima-Ku, Tokyo-To, both of Japan

[21] Appl. No.: 334,216

[22] Filed: Apr. 6, 1989

[30] Foreign Application Priority Data

Apr. 8, 1988 [JP] Japan ..... 63-85229

[51] Int. Cl.[5] ..... A46B 15/00

[52] U.S. Cl. ..... 15/244.1; 15/244.4; 300/21

[58] Field of Search ..... 15/244.1, 244.4, 244.3; 300/21

[56] References Cited

U.S. PATENT DOCUMENTS

| | | | |
|---|---|---|---|
| 982,232 | 1/1911 | Bartholomew | 15/244.1 X |
| 2,555,858 | 6/1951 | Olesky | 15/244.1 |
| 2,570,596 | 10/1951 | Ross | 15/244.1 |
| 3,568,236 | 3/1971 | Aston | 15/244.1 |
| 3,645,821 | 2/1972 | Baumann et al. | 15/244.1 |
| 3,951,460 | 4/1976 | Blankschein | 15/244.1 |

FOREIGN PATENT DOCUMENTS

| | | | |
|---|---|---|---|
| 254069 | 7/1926 | United Kingdom | 15/244 R |
| 270236 | 9/1926 | United Kingdom | 15/244 X |

*Primary Examiner*—Frankie L. Stinson

*Attorney, Agent, or Firm*—Andrus, Seales, Starke & Sawall

[57] ABSTRACT

An applicator serving as a cosmetic accessory of the type including a core rod and a sponge portion serving as brushing means at an inner end of the core rod, the sponge portion being molded integral with the core rod and the subjected to foaming, wherein the sponge portion is provided with disconnection preventive means preferably in the form of an enlarged part molded integral with the core rod and the disconnection preventive means is coated with a rubber film so that the sponge portion is firmly connected to the core rod via the rubber film. The method of producing applicators is generally practiced by way of steps of coating the disconnection preventive means with a rubber film, molding sponge portions in a plurality of molding cavities together with the core rods fitted to a cover, foaming raw material in the molding cavities at a predetermined elevated temperature and removing the cover from the molding cavities so that the core rod and the sponge portions are removed therefrom. The step of molding may be performed in a single box-shaped molding cavity. The resultant sponge block is cut to a plurality of sponge segments between adjacent core rods. The step of pouring raw material may be performed either before or after the step of closing the cover having the core rods fitted thereto.

8 Claims, 3 Drawing Sheets

COSMETIC APPLICATOR AND METHOD OF PRODUCING THE SAME

BACKGROUND OF THE INVENTION

1. Technical Field

The present invention relates to an applicator serving as a cosmetic accessory of the type including a sponge portion serving as brushing means attached to the inner end of a core rod so as to allow a cosmetic material such as a rouge, a foundation or the like to be applied. Further, it relates to a method of producing applicators each serving as a cosmetic accessory of the foregoing type.

2. Description of the Related Art

Generally, a hitherto known cosmetic applicator is so constructed that the fore end part of a core rod molded of synthetic resin is coated with an adhesive and then it is inserted into an area extending between a pair of sponge pieces so that it is adhered to them or a sponge block is preformed and a core rod of which fore end part is coated with an adhesive is plunged into the sponge block.

With the conventional applicator as constructed in the above-described manner, the core rod tends to be disconnected from the sponge portion due to deterioration of the adhesive after it has been used for a long time or when it is used in a violent manner.

To obviate the foregoing problem, the inventors have developed an improved applicator as disclosed in Japanese Laid-Open Patent No. 144,602/1987, wherein the core rod is provided with a disconnection preventive portion in the form of an enlarged portion, a protrusion, a bent portion or the like at its inner end so as to prevent the sponge portion from being disconnected from the core rod.

Although the improved applicator exhibits excellent properties when it is designed in comparatively large dimensions so that the core rod is provided with a large disconnection preventive portion, it has still a drawback that the sponge portion is liable to be disconnected from the core rod due to a low magnitude of resistance between the core rod and the sponge portion when it is designed in smaller dimensions as is the case with a so-called small-sized applicator.

SUMMARY OF THE INVENTION

The present invention has been made with the foregoing background in mind and its objects resides in providing a cosmetic applicator which assures that a sponge portion is reliably connected to a core rod without an occurrence of disconnection of the former from the latter.

To accomplish the above object, the present invention provides an applicator serving as a cosmetic accessory of the type including a core rod and a sponge portion serving as brushing means at an inner end of the core rod, the sponge portion being molded integral with the core rod and then subjected to foaming, wherein the sponge portion is provided with disconnection preventive means at the inner end of the core rod and the disconnection preventive means is coated with a rubber film so that the sponge portion is firmly connected to the core rod via the rubber film.

In practice, the disconnection preventive means is covered with the rubber film before the sponge portion is subjected to foaming.

Further, the present invention provides a method of producing applicators each serving as a cosmetic accessory comprising the steps of providing a die having a plurality of molding cavities formed therein, the molding cavities being arranged in a substantially equally spaced relationship and having an inner configuration corresponding to the outer configuration of a sponge portion, respectively, providing a cover in the form of a plate for the molding cavities, mounting a plurality of core rods to depend from the cover, the core rods being arranged in a substantially equally spaced relationship, each of the them having an outer rod portion fitted to the cover and an enlarged terminus portion serving as disconnection preventive means at its inner end, coating the enlarged terminus portion with a rubber film, stirring with addition of an air a raw foamable material to produce a raw foamed material, pouring the raw foamed material into the molding cavities, closing the cover so that at least the enlarged terminus portions of the core rods are disposed in the molding cavities and surrounded by the raw foamed material, holding the die and the cover closed until the raw foamed material has initially set so that the enlarged terminus portions of the core rods are integrally embedded in a sponge material to resist relative axial displacement between the core rod and the sponge material, heating the assembled die and cover to cur the sponge material in the respective molding cavities, and removing the cover from the die so that the core rods and the sponge material are removed from the molding cavities to form a plurality of applicators.

The step of pouring the raw foamed material may be performed either before or after the step of closing the cover.

The molding cavities may be replaced with a single box-shaped molding cavity. In this case, the resultant sponge block is cut to a plurality of sponge segments between adjacent core rods. Then, each of the sponge segments is subjected to trimming to provide a predetermined configuration.

Other objects, features and advantages of the present invention will become more readily apparent from a reading of the following description which has been made with reference to the accompanying drawings.

BRIEF DESCRIPTION OF THE DRAWINGS

The present invention is illustrated in the following drawings in which.

DESCRIPTION OF THE PREFERRED EMBODIMENTS

Now, the present invention will be described in more details hereinafter with reference to the accompanying drawings which illustrate preferred embodiments thereof.

Figure 1:
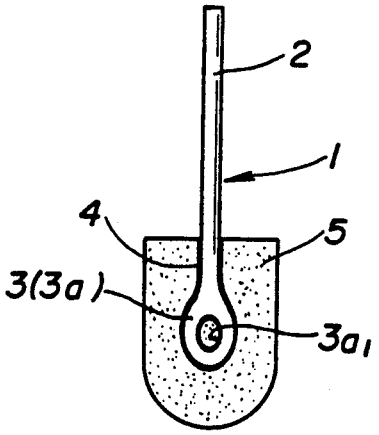
FIGS. 1 to 6 are vertical sectional views illustrating an applicator in accordance with various embodiments of the present invention.

FIG. 1 is a vertical sectional view illustrating a cosmetic applicator in accordance with an embodiment of the present invention. In the drawing, reference numeral 1 generally designates an applicator. Further, reference numeral 2 designates a core rod and reference numeral 3 does a disconnection preventive portion on the lower end of the core rod 2. In the illustrated embodiment, the disconnection preventive portion 3 is so constructed that the lower end of the core rod 2 is expanded to provide an enlarged portion $3_a$ and a through hole $3_{a1}$ is formed on the enlarged portion $3_a$. Reference numeral 4 designates a rubber film which is coated over the surface of the disconnection preventive portion 3 and reference numeral 5 does a sponge portion serving as brushing means.

Figure 2:
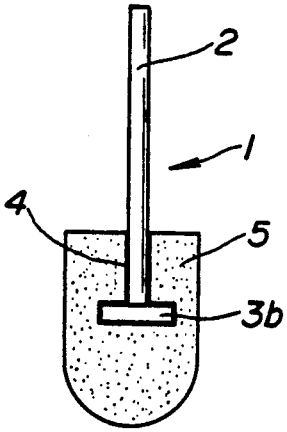
Figure 3:
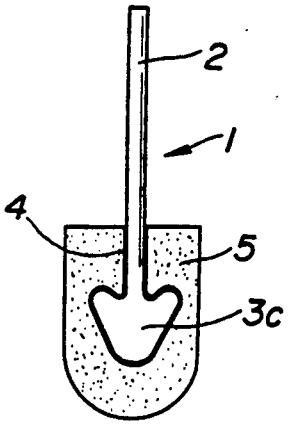
Figure 4:
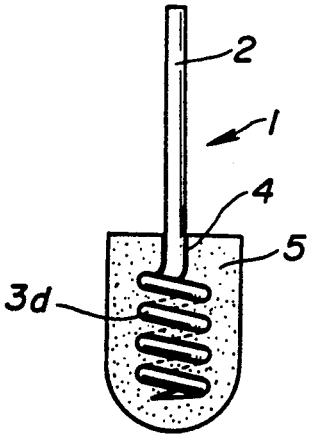
Figure 5:
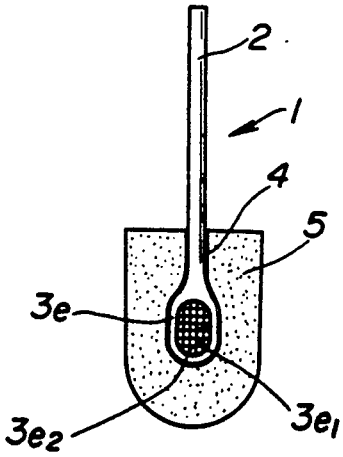
Figure 6:
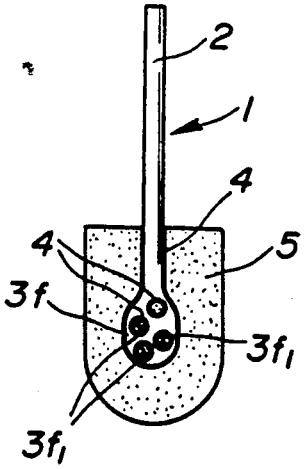

FIGS. 2 to 6 are vertical sectional views illustrating a disconnection preventive portion 3 for the applicator 1 in accordance with various embodiments of the present invention. Specifically, among these drawings, FIG. 2 illustrates a case where the disconnection preventive portion 3 is designed in the form of a flange-shaped disc $3_b$ which is molded integral with the lower end of the core rod 2, FIG. 3 illustrates a case where the disconnection preventive portion 3 is designed in the form of a substantially V-shaped anchor $3_c$ which is molded integral with the lower end of the core rod 2, FIG. 4 illustrates a case where the disconnection preventive portion 3 is designed in the form of a coil $3_d$ which constitutes an extension from the lower end of the core rod 2, FIG. 5 illustrate a case where the disconnection preventive portion 3 is designed in the form of a enlarged flat part $3_e$ which is molded integral with the lower end of the core rod 2, wherein the enlarged part $3_e$ is formed with a through hole $3_{e1}$ which is filled with a net $3_{e2}$, and FIG. 6 illustrates a case where the disconnection preventive portion 3 is designed in the form of an enlarged part $3_f$ which is molded integral with the lower end of the core rod 2, wherein the enlarged part $3_f$ is formed with a plurality of small through holes $3_{f1}$. With respect to the rubber film 4 and the sponge portion 5, the applicators 1 shown in FIGS. 2 to 6 are same to that in FIG. 1.

A material having an excellent affinity to the core rod made of synthetic resin is employable for the rubber film 4.

Next, a method of producing the sponge portion 5 will be described below with respect to the applicator 1 in FIG. 1 which illustrates by way example a core rod having a disconnection preventive portion attached thereto.

Figure 7:
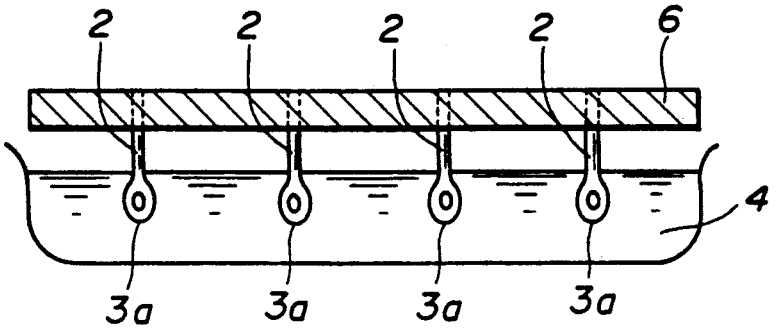
FIGS. 7 to 9 are vertical sectional views, particularly illustrating the steps of producing applicators in accordance with the method of the present invention.

First, a plurality of core rods 2 each having an enlarged part $3_a$ attached thereto are fitted to a fitting plate 6 in a substantially equally spaced relationship while depending therefrom. Then, a rubber film 4 is coated over the surface of each of the expanded parts $3_a$. Usually, a coating method employable for the rubber films 4 is such that the respective enlarged parts $3_a$ are coated with rubber material using a brush or the like means. Alternatively, as shown in FIG. 7, the coating method may be practiced for forming rubber films 4 by immersing the enlarged parts $3_a$ in a bath of liquid which comprises a mixture of material suitable for the rubber films 4 (e.g., Bond G 17 produced by Konishi Co., Ltd., Osaka) and solvent for diluting the foregoing material. Incidentally, in a case where an adhesive is employed as a material for the rubber films 4, the solvent is dried by vaporization so as to allow the adhesive to exhibit its own adhering function.

Figure 8:
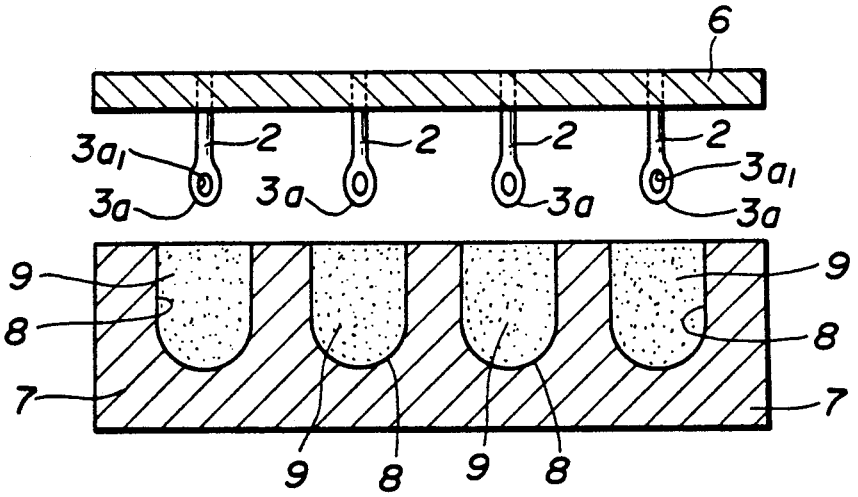

Next, a molding die 7 is provided which is formed with a plurality of molding cavities 8 in a substantially equally spaced relationship in correspondence to the core rods 2 depending from the fitting plate 6. Then, a sponge material 9 which has been prepared by way of steps of adding to an acrylonitrile butadiene latex a predetermined amount of vulcanizing agent, vulcanization assistant, vulcanization accelerator and aging preventive agent, introducing an air into the mixture, stirring the latter and then causing it to be foamed, is poured in the respective molding cavities 8, as shown in FIG. 8. Thereafter, the fitting plate 6 is quickly placed on the molding die 7 prior to solidifying (gelling) of the sponge material 9 in such a manner that the respective core rods 2 are located in alignment with the centers of the molding cavities 8 (see FIG. 9). While the foregoing state is maintained, the sponge material 9 remains still for a period of one to several minutes. After the latex is solidified, the sponge material 9 is put in a steam oven (not shown) together with the molding die 7 so that it receives a heat treatment at a temperature of about 100° C. for about 30 minutes. On completion of the heat treatment, the sponge material 9 is removed from the steam oven so that it is dewatered and dried. Thereafter, the sponge material 9 of which strength has been increased is removed from the molding die 7. Then, the core rods 2 are removed from the fitting plate 6. Consequently, the applicator 1 including a sponge portion 5 at the lower end of the core rod 2 as shown in FIG. 1 has been produced.

Alternatively, the method of the present invention may be practiced in such a manner that core rods 2 are previously put in molding cavities 8 on the molding die 7 and then the sponge material 9 which has been foamed is introduced into the molding cavities 8. This modified method is advantageously employed when comparatively small applicators (each comprising a sponge portion and a core rod) are produced while the sponge material 9 is sufficiently and uniformly distributed into the respective molding cavities 8.

Figure 9:
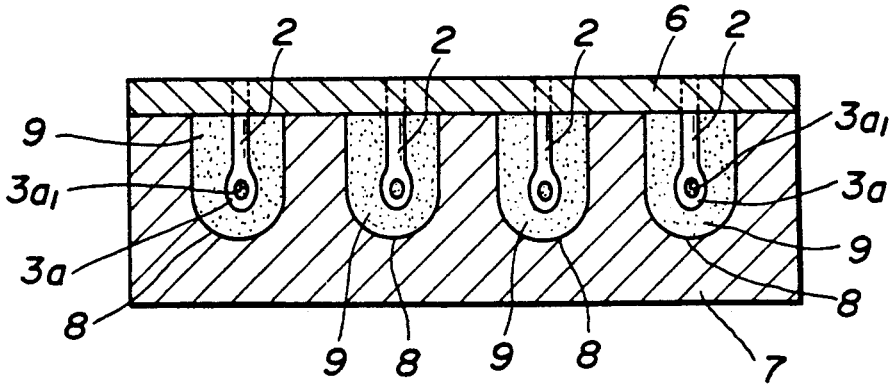

The method of producing sponge portions 5 has been described above with reference to FIG. 1 as to an embodiment of the method of producing disconnection preventive portions 3. However, the present invention should not be limited only to this. The aforementioned method of producing sponge portions 5 is likewise applicable to the sponge portions 5 as shown in FIGS. 2 to 6. As required, the sponge portions 5 may be ground after they are produced in accordance with the method as shown in FIGS. 7 to 9.

Figure 10:
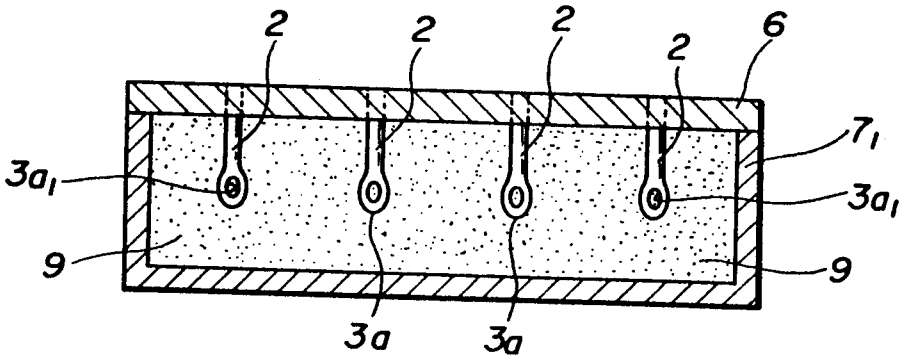
FIG. 10 is a vertical sectional view, particularly illustrating the method of producing applicators in accordance with other embodiment of the present invention.

FIG. 10 is a vertical sectional view which schematically illustrating a method of producing sponge portions using a molding die $7_1$ in place of the molding die 7 in the foregoing method, wherein the molding die $7_1$ is designed in a box-shaped hollow configuration. In the same manner as the aforementioned embodiment, after a rubber film 4 is coated over the surface of the respective enlarged parts $3_a$ of the core rods 2, a sponge material 9 which has been foamed is introduced into the molding die 71, the fitting plate 6 is placed on the molding die 2 and the latex is then solidified and cooled, whereby a single block-shaped sponge portion is produced. Then, the resultant sponge portion is disconnected from the fitting plate 6, a cutting operation is performed between the adjacent core rods 2 and the outer surface of the respective sponge segments is trimmed to a required configuration. Consequently, the same sponge portion as those mentioned above has been produced.

In this embodiment, there is no need of separately providing a molding die having a plurality of molding cavities formed thereon in correspondence to sizes of a required sponge portion. A number of various kinds of sponge portions 5 can be produced using a single molding die by adjusting a distance between the adjacent core rods 2 while the latter are fitted to the fitting plate 6 at positions offset from the preceding ones. Since a large quantity of raw material is poured in the interior of the molding die 7 at a time, a number of sponge portions each having a stable structure can be produced with a high productivity.

EXAMPLE

Figure 11:
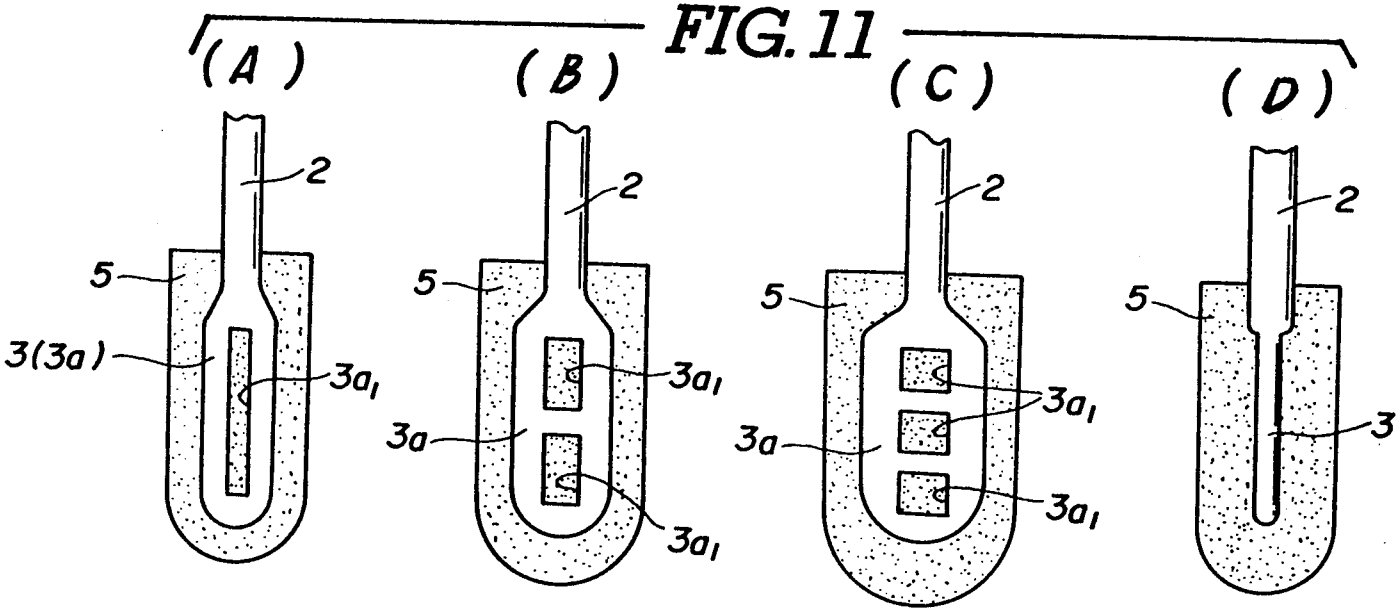
FIGS. 11(A) to (D) are vertical sectional view illustrating a part of the core rod having an enlarged portion formed thereon which was used for a test.

To clarify advantages provided by the present invention, a number of tests were conducted for cosmetic applicators produced in accordance with the present invention and cosmetic applicators (each including a disconnection preventive portions 3 with no rubber film coated thereon) produced in accordance with the aforementioned prior invention of Japanese Laid-Open patent No. 144,602/1987 using a tensile strength testing machine. In practice, the tests were conducted with respect to applicators each having a different hole area (in total) due to varied shape, size and number of through holes $3_{a1}$ on an enlarged part $3_a$ as shown in FIGS. 11(A) to (C) in such a manner that core rods 2 were kept immovable and sponge portions 5 were pulled so as to measure an intensity of pulling force appearing when the sponge portions 5 were disconnected from the core rods 2. Results derived from the tests are as noted on the following table. It should be noted that hole areas in the table correspond to FIGS. 11(A) to (C).

TABLE (DATA DERIVED FROM PULLING TESTS)

| hole area | applicator having rubber film | applicator having no rubber film |
|---|---|---|
| 9 $mm^2$ | 480 g | 300 g |
| 14 $mm^2$ | 800 g | 500 g |
| 45 $mm^2$ | 1300 g | 1200 g |

As will be apparent from the above table, it was found with respect to the applicators of the present invention used for the tests that a higher intensity of pulling force was required for disconnecting the sponge portion 5 from the core rod 2, compared with the conventional applicator having no rubber film formed thereon. Obviously, this is attributable to the fact that the sponge portion 5 was firmly secured to the core rod 2. Particularly, it was found that the advantageous feature of the present invention became remarkable as a diameter of the respective through holes $3_{a1}$ on the enlarged part $3_a$ was reduced more and more.

Also with respect to the applicator of the present invention of which disconnection preventive portion 3 had such a configuration that the core rod 2 had a reduced diameter at its fore end part and a sponge portion 5 was attached thereto, it was found that it exhibited the same advantageous effect as the foregoing one, although it had a different configuration from those in FIGS. 11(A) to (C). Further, it was found with respect to all the applicators as mentioned above that the sponge portion 5 was not disconnected from the core rod 2 until the sponge material was torn. This is attributable to the fact that the sponge portion 5 was firmly connected to the core rod 2 in the presence of the rubber film 4 (constituted by an adhesive) irrespective of a small quantity of sponge material filled in the through holes $3_{a1}$ on the enlarged part $3_a$ of the core rod 2.

Incidentally, the tests have been described above with respect to the disconnection preventive portion 3 in accordance with the embodiment as shown in FIG. 1. However, it will be obvious for any expert in the art that things are same with the disconnection preventive portions as shown in FIGS. 2 to 6.

As will be apparent from the above description, the present invention has provided a cosmetic applicator of the type including a sponge portion serving as brushing means at an inner end of a core rod, wherein disconnection preventive means in the sponge portion is covered with a rubber film before the sponge portion is subjected to foaming. With the applicator of the present invention, the sponge portion is more firmly connected to the core rod than the conventional applicator. Particularly, with the conventional applicator designed in smaller dimensions, it has been often found that the sponge portion is disconnected from the core rod due to a small quantity of joint area between the core rod and the foamed sponge portion irrespective of provision of the disconnecting preventive means. According to the present invention, since the core rod is firmly connected to the sponge portion in the presence of the rubber film, a malfunction that the sponge portion is disconnected from the core rod does not occur. Consequently, a cosmetic applicator having an excellent property of durability can be produced in accordance with the method of the present invention.

Further, according to the present invention, in a case where an adhesive is employed for forming the rubber film, there is no fear that properties of the applicator are degraded due to the fact that the adhesive oozes in the sponge portion during a period of usage, causing the sponge portion to be hardened, because the sponge portion is subjected to foaming after the adhesive is dried.

What is claimed is:

1. An applicator serving as a cosmetic accessory comprising:

(a) a core rod, (b) a sponge portion serving as brushing means at one end of said core rod, (c) disconnection preventive means molded integral with the core rod for preventing said brushing means from being disconnected from the core rod, (d) said disconnection preventive means having thereon a coating of a rubber-dissolved solution, and, (e) said sponge portion being integrated with the core rod by foaming, after a film of rubber provided by said coating of the rubber-dissolved solution is dried.

2. The application as claimed in claim 1, wherein said coating of said rubber-dissolved solution is achieved by immersing the disconnection preventive means in a container or the like means in which the rubber-dissolved solution is received.

3. The applicator as claimed in claim 2, wherein said disconnection preventive means is provided in the form of an enlarged portion having a through hole formed thereon, said through hole being filled with the foamed sponge material.

4. The applicator as claimed in claim 2, wherein said disconnection preventive means is provided in the form of a flange-shaped disc which is made integral with the core rod.

5. The applicator as claimed in claim 2, wherein said disconnection preventive means is provided in the form of a substantially V-shaped anchor.

6. The applicator as claimed in claim 2, wherein said disconnection preventive means is provided in the form of a coil which constitutes an extension from the inner end of the core rod.

7. The applicator as claimed in claim 2, wherein said disconnection preventive means is provided in the form of a enlarged portion having a through hole formed therein, said through hole being covered with netting means and filled with the foamed sponge material.

8. The applicator as claimed in claim 2, wherein said disconnection preventive means is provided in the form of an enlarged portion having a plurality of through holes formed therein, said through holes being filled with the foamed sponge material.

* * * * *